US011192671B2

(12) United States Patent
Johnson et al.

(10) Patent No.: US 11,192,671 B2
(45) Date of Patent: Dec. 7, 2021

(54) SYSTEM AND A RELATED METHOD FOR FORMING A MULTI-CHAMBER PACKAGE

(71) Applicant: Church & Dwight Co., Inc., Princeton, NJ (US)

(72) Inventors: Thomas Johnson, Hightstown, NJ (US); Carl Henry, Newtown, PA (US); Jonathan Wharton, Ewing, NJ (US)

(73) Assignee: Church & Dwight, Co., Inc., Princeton, NJ (US)

( * ) Notice: Subject to any disclaimer, the term of this patent is extended or adjusted under 35 U.S.C. 154(b) by 173 days.

(21) Appl. No.: 16/475,231

(22) PCT Filed: Jan. 4, 2018

(86) PCT No.: PCT/US2018/012298
§ 371 (c)(1),
(2) Date: Jul. 1, 2019

(87) PCT Pub. No.: WO2018/129124
PCT Pub. Date: Jul. 12, 2018

(65) Prior Publication Data

US 2019/0337650 A1 Nov. 7, 2019

Related U.S. Application Data

(60) Provisional application No. 62/442,141, filed on Jan. 4, 2017.

(51) Int. Cl.
*B65B 9/08* (2012.01)
*B65B 1/04* (2006.01)
(Continued)

(52) U.S. Cl.
CPC ..... *B65B 9/08* (2013.01); *B65B 1/04* (2013.01); *B65B 9/06* (2013.01); *B65B 61/06* (2013.01);
(Continued)

(58) Field of Classification Search
CPC .... B65B 1/04; B65B 1/02; B65B 9/08; B65B 9/06; B65B 9/00; B65B 2210/06;
(Continued)

(56) References Cited

U.S. PATENT DOCUMENTS 2,251,671 A * 8/1941 Forst ..... B65B 49/14 53/209
3,232,024 A * 2/1966 Brown ..... B65B 47/04 53/559
(Continued)

FOREIGN PATENT DOCUMENTS

DE 19548182 6/1997
EP 1506925 2/2005
(Continued)

*Primary Examiner* — Thomas M Wittenschlaeger
(74) *Attorney, Agent, or Firm* — Church & Dwight, Co., Inc.

(57) ABSTRACT

A system and a related method for forming a multi-chamber package are disclosed. The system includes a single web of a film material extending in a machine direction and defining a plurality of lateral lanes extending contiguously in a cross-machine direction, orthogonal to the machine direction. The system also includes a forming arrangement configured to interact with the web to form chambers along a second lane of the plurality of lateral lanes in the machine direction, a first filling device configured to deposit a first substance into one or more of the formed chambers of the second lane, and a first folding mechanism configured to form a fold between the lateral lanes in the machine direction such that a first lane of the plurality of lateral lanes is directed to overlie the one or more formed chambers of the second lane.

24 Claims, 5 Drawing Sheets

(51) Int. Cl.
*B65B 61/06* (2006.01)
*C11D 17/04* (2006.01)
*B65B 9/06* (2012.01)

(52) U.S. Cl.
CPC ..... *C11D 17/045* (2013.01); *B65B 2210/06* (2013.01); *B65B 2220/22* (2013.01)

(58) Field of Classification Search
CPC ..... B65B 61/06; B65B 2220/22; B65B 3/02; B65B 5/026; B65B 47/00; B65B 47/04; B65B 47/06; B65B 47/08; B65B 47/10; B65B 49/00; B65B 49/02; B65B 49/04; B65B 49/14; B65B 2230/04; C11D 17/045
See application file for complete search history.

(56) References Cited

U.S. PATENT DOCUMENTS 3,469,768 A 9/1969 Repko
3,512,332 A * 5/1970 Klein ..... B65B 11/52 53/449
3,593,485 A * 7/1971 Stovall ..... B65B 9/06 53/450
3,953,273 A * 4/1976 Faller ..... B29C 51/162 156/224
4,205,504 A * 6/1980 Gregoire ..... B31B 70/262 53/520
4,249,659 A * 2/1981 Schirmer ..... B65B 9/00 206/471
4,548,322 A 10/1985 Cullen et al.
4,870,804 A * 10/1989 Yokoyama ..... B65B 3/02 53/450
5,109,984 A * 5/1992 Romick ..... B65D 83/0463 206/531
5,404,693 A * 4/1995 Giovannone ..... B29C 66/131 53/453
5,881,538 A * 3/1999 Blohm ..... B65B 25/002 53/461
6,282,870 B1 * 9/2001 Robache ..... B65B 9/00 53/377.6
6,378,274 B1 4/2002 Harbour
6,874,300 B2 4/2005 Di Lauretis et al.
6,883,295 B1 4/2005 Negri et al.
6,898,921 B2 5/2005 Duffield
6,995,126 B2 2/2006 Perkis et al.
7,011,615 B2 3/2006 Price et al.
7,013,623 B2 3/2006 Fisher et al.
7,125,828 B2 10/2006 Alexandre et al.
7,127,874 B2 10/2006 Viltro et al.
7,201,819 B2 4/2007 Wiedemann et al.
7,214,722 B2 5/2007 Kinloch et al.
7,219,484 B2 5/2007 Duffield et al.
7,386,971 B2 6/2008 Catlin et al.
7,439,215 B2 10/2008 Catlin et al.
7,464,519 B2 12/2008 Fisher et al.
7,469,519 B2 12/2008 Barthel et al.
7,550,421 B2 6/2009 Sharma et al.
7,578,114 B2 8/2009 Duffield et al.
7,601,679 B2 10/2009 Weber et al.
7,607,281 B2 10/2009 Freddi
7,648,951 B2 1/2010 Sharma et al.
7,677,015 B2 3/2010 Kroese et al.
7,797,912 B2 9/2010 Hammond et al.
7,891,515 B2 2/2011 Bourgoin et al.
7,954,307 B2 6/2011 Paunesku et al.
8,042,318 B2 10/2011 Ayats et al.
8,156,713 B2 4/2012 Alexandre et al.
8,201,386 B2 * 6/2012 Oba ..... B65B 9/06 53/429
8,215,088 B2 7/2012 Vaillant et al.
8,250,837 B2 8/2012 Catlin et al.
8,282,538 B2 10/2012 Paunesku et al.
8,283,300 B2 10/2012 Catlin et al.
8,435,935 B2 5/2013 Catlin et al.
8,469,192 B2 * 6/2013 Oba ..... B65B 9/06 206/440
8,518,866 B2 8/2013 Catlin et al.
8,631,729 B2 1/2014 Paunesku et al.
8,656,689 B2 2/2014 Denome et al.
8,658,585 B2 2/2014 Catlin et al.
8,662,880 B2 3/2014 Fowler et al.
8,669,219 B2 3/2014 Wiedemann et al.
8,669,220 B2 3/2014 Huber et al.
8,754,025 B2 6/2014 Wiedemann et al.
8,940,676 B2 1/2015 Catlin et al.
9,073,294 B2 7/2015 Kumar et al.
9,162,413 B2 10/2015 Hartman et al.
9,233,768 B2 1/2016 Meskens et al.
9,249,380 B2 2/2016 Gordon et al.
10,633,128 B2 * 4/2020 Este ..... B65B 11/52
10,844,183 B2 * 11/2020 Friedrich ..... C11D 17/045
2005/0079252 A1 4/2005 Kendig et al.
2005/0263428 A1 12/2005 Duffield et al.
2008/0014392 A1 * 1/2008 Ayats ..... C11D 17/06 428/35.7
2012/0192900 A1 8/2012 Wiedemann et al.
2013/0219827 A1 8/2013 Pallotta et al.
2013/0219832 A1 8/2013 Pallotta et al.
2014/0053512 A1 2/2014 Yeaman et al.
2014/0054831 A1 2/2014 Emerson et al.
2014/0124990 A1 5/2014 Fowler et al.
2014/0154350 A1 6/2014 Hammond et al.
2014/0158251 A1 6/2014 Meyer et al.
2014/0228194 A1 8/2014 Kepinski et al.
2014/0235522 A1 8/2014 Wiedemann et al.
2014/0345064 A1 11/2014 Koch et al.
2015/0068156 A1 3/2015 Zhou et al.
2015/0071572 A1 3/2015 Dreher et al.
2015/0136637 A1 5/2015 Meier et al.
2015/0158645 A1 6/2015 Meier et al.
2015/0158646 A1 6/2015 Meier et al.
2015/0197352 A1 7/2015 Hartman et al.
2015/0210968 A1 7/2015 Lopes et al.
2015/0251403 A1 9/2015 Orndorff et al.
2015/0251782 A1 9/2015 Orndorff et al.
2015/0251783 A1 9/2015 Orndorff
2015/0252304 A1 9/2015 Souter et al.
2015/0252305 A1 9/2015 Souter et al.
2015/0274413 A1 10/2015 Brandt et al.
2015/0291300 A1 10/2015 Brandt et al.
2015/0336691 A1 11/2015 Fowler et al.
2015/0336692 A1 * 11/2015 Brandt Sanz ..... B65B 39/14 53/450
2016/0017264 A1 1/2016 Cumming et al.
2016/0068285 A1 3/2016 Fowler et al.
2016/0102278 A1 * 4/2016 Labeque ..... C11D 17/045 510/296
2016/0130538 A1 5/2016 Cooley et al.
2016/0176554 A1 * 6/2016 Blake ..... A21D 13/80 426/128
2016/0340068 A1 11/2016 Brandt
2017/0226298 A1 * 8/2017 Friedrich ..... B65D 75/20
2020/0362275 A1 * 11/2020 Vitiello ..... C08F 220/14
2020/0362276 A1 * 11/2020 Vitiello ..... C11D 11/0023

FOREIGN PATENT DOCUMENTS

EP 1379433 2/2006
EP 1341695 6/2008
EP 1506924 6/2008
EP 2567898 3/2013
GB 2362868 12/2001
JP 2908593 6/1999
WO 2007007035 1/2007
WO 2015091209 6/2015
WO 2015150230 10/2015
WO 2015150231 10/2015
WO 2015160258 10/2015

* cited by examiner

SYSTEM AND A RELATED METHOD FOR FORMING A MULTI-CHAMBER PACKAGE

CROSS-REFERENCE TO RELATED APPLICATIONS

This application is a national stage filing under 35 U.S.C. § 371 of PCT/US2018/012298, filed Jan. 4, 2018, which International Application was published by the International Bureau in English on Jul. 12, 2018, and claims priority from U.S. Provisional Application No. 62/442,141, filed on Jan. 4, 2017, which applications are hereby incorporated by reference in their entirety in this application.

BACKGROUND

Field of the Disclosure

The present disclosure relates to a system and a related method for forming a multi-chamber package. More particularly, the present disclosure relates to a system and method for folding a single web of film material over on itself to form a multi-chamber package for use in laundry and dishwashing applications.

Description of Related Art

Various types of multi-chamber packages (e.g., unit dose packs, pods, cavity tablets, etc.) have been used for many years in the area of household care to provide a single-use, pre-dosed quantity of detergent in laundry and dishwashing applications. These types of multi-chamber packages are generally formed from multiple webs of film material that are in some way bonded together. Once the multiple webs of film material are bonded together, individual multi-chamber packages are then typically cut so that the assembled webs form the multi-chamber packages. In particular instances, some webs of film material are conventionally manufactured in contiguous 54 inch wide rolls, but are used in standard packaging equipment that can only process 26.75 inch wide films. The 54 inch rolls are then cut to a width that can be processed by this equipment. In the case of a 54 inch wide roll used with equipment that can only process up to 26.75 inch wide films, the 54 inch wide roll may be halved along its length to produce two 27 inch wide rolls. These 27 inch wide rolls may then each be further trimmed to a width of 26.75 inches in order to be processed in standard packaging equipment. However, such a process may be time consuming and wasteful of the material trimmed away from each 27 inch roll. In addition, it may be difficult to control or track a production lot of the multi-chamber packages produced from a single roll.

Accordingly, there remains a need for improved systems and methods for forming multi-chamber packages that particularly reduce waste and, thus, improve the cost and efficiency of forming multi-chamber packages.

SUMMARY OF THE DISCLOSURE

The present disclosure relates to a system and a related method for forming a multi-chamber package. In some aspects, a system for forming a multi-chamber package comprises a single web of a film material extending in a machine direction and defining a plurality of lateral lanes extending contiguously in a cross-machine direction, orthogonal to the machine direction, a forming arrangement configured to interact with the web to form chambers along a second lane of the plurality of lateral lanes in the machine direction, a first filling device configured to deposit a first substance into one or more of the formed chambers of the second lane, and a first folding mechanism configured to form a fold between the lateral lanes in the machine direction such that a first lane of the plurality of lateral lanes is directed to overlie the one or more formed chambers of the second lane, so as to form one or more multi-chamber packages.

In further aspects, a method for forming a multi-chamber package comprises interacting a forming arrangement with a single web of film material extending in a machine direction, the web defining a plurality of lateral lanes extending contiguously in a cross-machine direction, orthogonal to the machine direction, so as to form chambers along a second lane of the plurality of lateral lanes in the machine direction, depositing a first substance into one or more of the formed chambers of the second lane with a first filling device, and forming a fold between the lateral lanes in the machine direction with a first folding mechanism such that a first lane of the plurality of lateral lanes is directed to overlie the one or more formed chambers of the second lane, so as to form one or more multi-chamber packages.

The present disclosure thus includes, without limitation, the following embodiments:

Embodiment 1: A system for forming a multi-chamber package, the system comprising: a single web of a film material extending in a machine direction and defining a plurality of lateral lanes extending contiguously in a cross-machine direction, orthogonal to the machine direction; a forming arrangement configured to interact with the web to form chambers along a second lane of the plurality of lateral lanes in the machine direction; a first filling device configured to deposit a first substance into one or more of the formed chambers of the second lane; and a first folding mechanism configured to form a fold between the lateral lanes in the machine direction such that a first lane of the plurality of lateral lanes is directed to overlie the one or more formed chambers of the second lane, so as to form one or more multi-chamber packages.

Embodiment 2: The system of any preceding embodiment, or any combination of any preceding embodiment, wherein the film material comprises a water soluble film material.

Embodiment 3: The system of any preceding embodiment, or any combination of any preceding embodiment, wherein the web has a lateral width of about 54 inches orthogonally to the machine direction.

Embodiment 4: The system of any preceding embodiment, or any combination of any preceding embodiment, wherein the plurality of lateral lanes includes a third lane extending contiguously from the second lane in a cross-machine direction, orthogonal to the machine direction, and wherein the forming arrangement is further configured to interact with the web to form chambers along the third lane in the machine direction.

Embodiment 5: The system of any preceding embodiment, or any combination of any preceding embodiment, wherein the forming arrangement is configured to exert a negative pressure through a platen having the web engaged therewith so as to form the chambers in the second lane or the third lane.

Embodiment 6: The system of any preceding embodiment, or any combination of any preceding embodiment, comprising a second filling device configured to deposit a second substance into one or more of the formed chambers of the third lane.

Embodiment 7: The system of any preceding embodiment, or any combination of any preceding embodiment, wherein each of the first and second substances comprises a powder, a liquid, a gel, a plurality of microbeads, or a combination thereof.

Embodiment 8: The system of any preceding embodiment, or any combination of any preceding embodiment, wherein the first substance is different from the second substance.

Embodiment 9: The system of any preceding embodiment, or any combination of any preceding embodiment, comprising a second folding mechanism configured to form a fold between the lateral lanes in the machine direction such that a second lane is directed to overlie the one or more formed chambers of the third lane, with the first lane being disposed therebetween, so as to form one or more multi-chamber packages.

Embodiment 10: The system of any preceding embodiment, or any combination of any preceding embodiment, wherein the web includes an axis of symmetry extending in the machine direction, such that the first through third lanes are mirrored on each side of the axis of symmetry, and wherein the forming arrangement, the first and second filling devices, and the first and second folding mechanisms are mirrored on each side of the axis of symmetry.

Embodiment 11: The system of any preceding embodiment, or any combination of any preceding embodiment, comprising a cutting mechanism configured to divide the web between adjacent multi-chamber packages, such that each resulting individual multi-chamber package includes a formed chamber of the second lane having the first substance therein and a chamber of the third lane having the second substance therein.

Embodiment 12: The system of any preceding embodiment, or any combination of any preceding embodiment, wherein the second lane includes discrete regions devoid of the formed chambers, the discrete regions corresponding to the formed chambers in the third lane such that, upon the second lane being folded with respect to the third lane, with the first lane therebetween, a multi-chamber package is formed comprising two chambers disposed laterally adjacent to one another.

Embodiment 13: The system of any preceding embodiment, or any combination of any preceding embodiment, wherein the second lane includes discrete regions comprising the formed chambers, the discrete regions corresponding to the formed chambers in the third lane such that, upon the second lane being folded with respect to the third lane, with the first lane therebetween, a multi-chamber package is formed comprising two superposed chambers.

Embodiment 14: The system of any preceding embodiment, or any combination of any preceding embodiment, comprising at least one cleaning device configured to remove unwanted material from the formed chambers.

Embodiment 15: The system of any preceding embodiment, or any combination of any preceding embodiment, further comprising at least one sealing device configured to apply an aqueous fluid to the first lane or about the formed chambers of the second lane in order to seal the formed chambers upon the first lane being folded to overlie the one or more formed chambers of the second lane.

Embodiment 16: A method for forming a multi-chamber package, the method comprising: (a) interacting a forming arrangement with a single web of film material extending in a machine direction, the web defining a plurality of lateral lanes extending contiguously in a cross-machine direction, orthogonal to the machine direction, so as to form chambers along a second lane of the plurality of lateral lanes in the machine direction; (b) depositing a first substance into one or more of the formed chambers of the second lane with a first filling device; and (c) forming a fold between the lateral lanes in the machine direction with a first folding mechanism such that a first lane of the plurality of lateral lanes is directed to overlie the one or more formed chambers of the second lane, so as to form one or more multi-chamber packages.

Embodiment 17: The method of any preceding embodiment, or any combination of any preceding embodiment, wherein the plurality of lateral lanes includes a third lane extending contiguously from the second lane in a cross-machine direction, orthogonal to the machine direction, and wherein step (a) further comprises interacting the forming arrangement with the web to form chambers along the third lane in the machine direction.

Embodiment 18: The method of any preceding embodiment, or any combination of any preceding embodiment, wherein step (a) further comprises exerting negative pressure through a platen having the web engaged therewith so as to form the chambers in the second lane or the third lane.

Embodiment 19: The method of any preceding embodiment, or any combination of any preceding embodiment, wherein step (b) further comprises depositing a second substance into one or more of the formed chambers of the third lane with a second filling device.

Embodiment 20: The method of any preceding embodiment, or any combination of any preceding embodiment, wherein the web includes an axis of symmetry extending in the machine direction, such that the method comprises mirroring steps (a)-(c) on each side of the axis of symmetry.

Embodiment 21: The method of any preceding embodiment, or any combination of any preceding embodiment, comprising dividing the web between adjacent multi-chamber packages with a cutting mechanism, such that each resulting individual multi-chamber package includes a formed chamber of the second lane having the first substance therein and a chamber of the third lane having the second substance therein.

Embodiment 22: The method of any preceding embodiment, or any combination of any preceding embodiment, wherein step (c) further comprises forming a fold between the lateral lanes in the machine direction with a second folding mechanism such that a second lane is directed to overlie the one or more formed chambers of the third lane, with the first lane being disposed therebetween, so as to form one or more multi-chamber packages.

Embodiment 23: The method of any preceding embodiment, or any combination of any preceding embodiment, wherein the second lane includes discrete regions devoid of the formed chambers, the discrete regions corresponding to the formed chambers in the third lane such that step (c) comprises forming a multi-chamber package comprising two chambers disposed laterally adjacent to one another upon the second lane being folded with respect to the third lane, with the first lane therebetween.

Embodiment 24: The method of any preceding embodiment, or any combination of any preceding embodiment, wherein the second lane includes discrete regions comprising the formed chambers, the discrete regions corresponding to the formed chambers in the third lane such that step (c) comprises forming a multi-chamber package comprising two superposed chambers upon the second lane being folded with respect to the third lane, with the first lane therebetween.

Embodiment 25: The method of any preceding embodiment, or any combination of any preceding embodiment, comprising removing unwanted material from the formed chambers using at least one cleaning device.

Embodiment 26: The method of any preceding embodiment, or any combination of any preceding embodiment, comprising applying an aqueous fluid to the first lane or about the formed chambers of the second lane using at least one sealing device in order to seal the formed chambers upon the first lane being folded to overlie the one or more formed chambers of the second lane.

These and other features, aspects, and advantages of the present disclosure will be apparent from a reading of the following detailed description together with the accompanying drawings, which are briefly described below. The present disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended to be combinable, unless the context of the disclosure clearly dictates otherwise.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

The present disclosure relates to a system and a related method for forming a multi-chamber package. The multi-chamber package comprises one or more substances deposited within the multiple chambers, such that the package is suitable for use in laundry and dishwashing applications. For example, the multi-chamber package is introduced into a detergent cavity in a washing machine or a dishwasher. The multi-chamber package is also usable in similar applications.

Figure 1A:
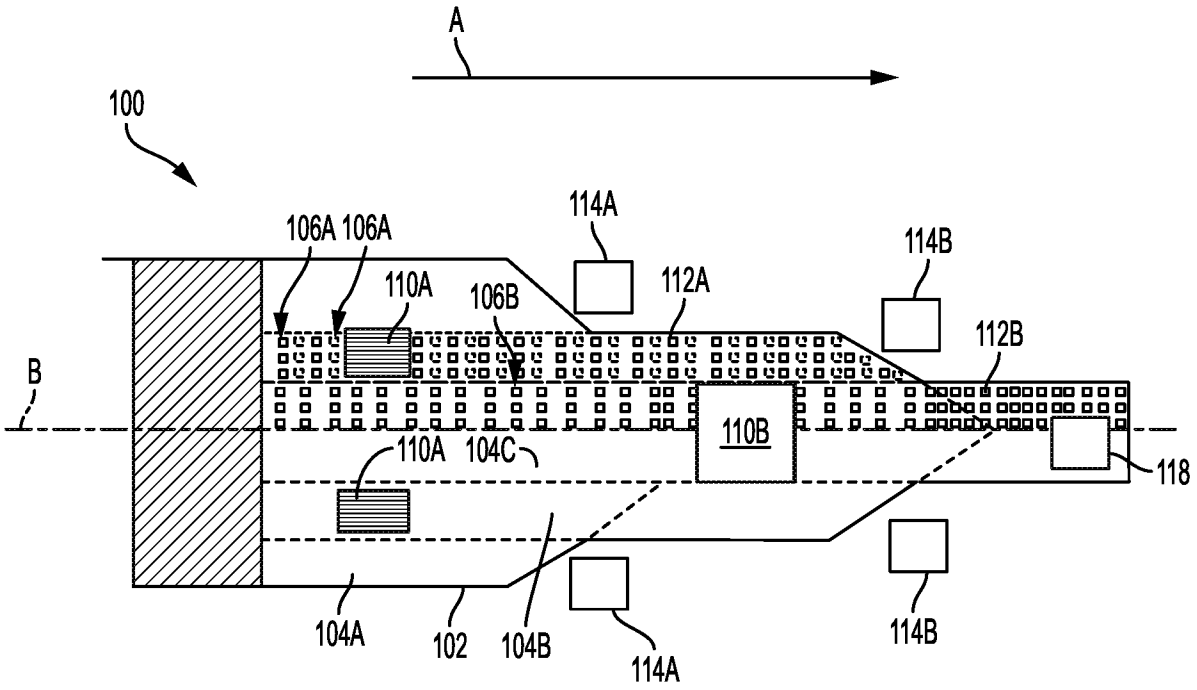
FIGS. 1A-1B illustrate a top view and a side view, respectively, of an exemplary system for forming a multi-chamber package, according to various aspects of the present disclosure.
Figure 1B:
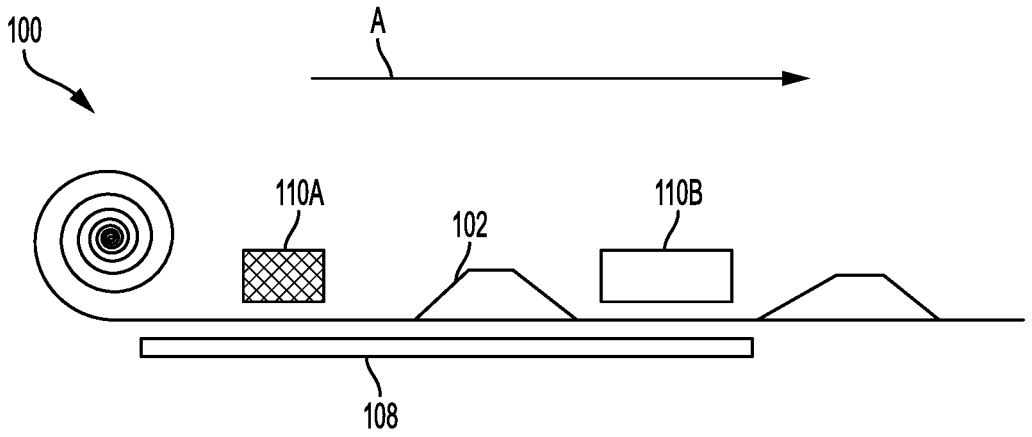

FIGS. 1A-1B illustrate a top view and a side view, respectively, of an exemplary system for forming a multi-chamber package, according to various aspects of the present disclosure. The exemplary system, generally designated 100, is configured to manipulate a single web of film material 102 by folding the web into a multi-chamber package for laundry and dishwashing applications. In some aspects, the web of film material 102 comprises a flexible, water soluble film material, such as a sheet-like flexible plastic formed of, for example, cellophane, polyethylene, acetates, polyvinyl alcohol (PVA), or the like, that is capable of having individual cavities formed therein, of being sealed and folded, etc. As illustrated in FIGS. 1A-B, the single web of film material 102 is initially provided in a continuous roll of material having a specified contiguous width. Conventional webs of film material are manufactured with a width larger than that which is able to be accommodated by most packaging systems of the type disclosed herein. Thus, conventional webs of film material are usually trimmed to fit to a system prior to forming the multi-chamber packages.

By contrast, embodiments of the system 100 disclosed herein are configured to accommodate a conventional web of film material 102 having a total width of approximately, for example, 54 inches, without the need to trim or in any way alter the web. The web of film material 102 extends contiguously in a machine direction, generally designated A, and travels in this direction during formation of the multi-chamber packages. A plurality of lanes 104A-C extending contiguously in a cross-machine direction, which is orthogonal to the machine direction A, are defined (e.g., by perforations, indentations, creases, or otherwise) by the web of film material 102. In some aspects, an axis of symmetry, generally designated B, extending in the machine direction A is defined by the web of film material 102. As such, in one aspect, the first through third lanes 104A-C are mirrored on each side of the axis of symmetry B such that all arrangements, machinery, methods, etc. disclosed herein, are mirrored on each side of the axis of symmetry B. Thus, formation speed of the multi-chambered packages is potentially doubled, as formation of the multi-chamber packages occurs in parallel processes or methods on each side of the axis of symmetry B. As such, utilizing at least substantially a full width of a conventional web of film material (e.g., web of film material 102) advantageously reduces waste and increases production efficiency in forming the multi-chamber packages, while allowing the production lot of the multi-chamber packages formed from a single roll or web of the film material to be more closely controlled or tracked.

As illustrated in FIG. 1A, the plurality of lanes 104A-C are disposed such that a second lane 104B is laterally disposed between a first lane 104A and a third lane 104C. The third lane 104C is defined as the laterally innermost lane in the single web of film material 102, while the first lane 104A is defined as the laterally outermost lane in the single web of film material 102. However, one of ordinary skill in the art will note that such a naming convention is merely used for convenience and is in no way limiting to the scope of the invention. More particularly, in some embodiments, the single web of film material defines a plurality of lanes that comprise more than three lanes or less than three lanes on either side of the axis of symmetry B.

In some aspects, a forming arrangement is configured to interact with the web 102 to form chambers 106A-B along one or more of the plurality of lateral lanes 104B-C. More particularly, for example, the forming arrangement is configured to exert a negative pressure through a platen (108, FIG. 1B) or other platform having the web 102 engaged therewith so as to form the chambers 106A-B in the second lane 104B and/or the third lane 104C of the web of film material 102. In some aspects, the platen 108 is configured with one or more depressions or cavities through which a vacuum (not shown) continuously exerts negative pressure. In this manner, the negative pressure is configured to draw the web of film material 102 into each of the one or more depressions or cavities in the platen 108 to thus form the chambers 106A-B.

The one or more depression or cavities in the platen 108 are provided in a manner corresponding to the style of multi-chamber package to be formed. For example, where a multi-chamber package having superposed chambers is desired, the platen 108 is configured with evenly spaced cavities extending in the machine direction A and for an entirety of or a substantial entirety of the cross-machine direction relative to both the second and third lanes 104B-C. In some aspects, the cavities in the platen 108 relative to both the second and third lanes 104B-C are spaced approximately $3/8^{th}$ of an inch apart from one another and are aligned in rows parallel to the machine direction A and columns parallel to the cross-machine direction.

In another example, where a multi-chamber package having side-by-side chambers is desired, the platen 108 is configured with evenly spaced cavities extending in the machine direction A and for a discrete portion, or an entirety of or a substantial entirety of the cross-machine direction relative to the second and/or third lanes 104B-104C. In this example, the platen 108 is configured such that there are only cavities in every other column in the cross-machine direction corresponding to the second lane 104B and/or the third lane 104C, such that the columns devoid of cavities relative to the second lane 104B align with the columns having cavities relative to the third lane 104C, and vice versa. Alternatively, the platen 108 is configured such that there are cavities in each column in the cross-machine direction in either one or both of the second lane 104B and the third lane 104C.

Where the cavities in the platen 108 relative to the second lane 104B and/or the third lane 104C are disposed over an entirety of or a substantial entirety of the cross-machine direction, the cavities are spaced approximately $3/8^{th}$ of an inch apart from one another and are aligned in rows parallel to the machine direction A and columns parallel to the cross-machine direction. By contrast, where the cavities in the platen 108 relative to the second lane 104B and/or the third lane 104C are disposed such that there are only cavities in every other column in the cross-machine direction, the cavities relative to the second lane 104B and/or the third lane 104C are spaced approximately 0.75 inches apart from one another and are aligned in rows parallel to the machine direction A and columns parallel to the cross-machine direction. Platen 108 is also configured with other configurations, sizes, shapes, etc., of cavities or depressions. In some aspects, platen 108 is configured as having the cavities 106A relative to the second lane 104B on a plane higher than the cavities 106B relative to the third lane 104C, or vice versa. Accordingly, in some aspects, depending on the style of multi-chamber package to be formed, different platens 108 are interchangeable in the system 100.

In some aspects, the platen 108 is configured to move with the web of film material 102 in the machine direction A throughout the formation of the multi-chamber package. In other aspects, the platen 108 is configured to be stationary, with dimensions of the platen 108 extending in the machine direction A sufficient to engage the web of film material 102 until the multi-chamber package is formed. Other types of forming arrangements are also contemplated with regard to the formation of the cavities 106A-B.

In some aspects, filling devices associated with system 100 are configured to deposit substances into one or more of the formed chambers 106A-B of the second lane 104B and the third lane 104C. FIGS. 1A-B illustrate filling devices 110A and 110B, respectively. The first filling device 110A is disposed such that it is associated specifically with the second lane 104B. FIG. 1A illustrates two, first filling devices 110A. The first filling devices 110A are disposed one on either side of the axis of symmetry B and are individually associated with the second lane 104B on each respective side. Alternatively, a single first filling device extending in the cross-machine direction is associated with the second lanes 104B on each side of the axis of symmetry B. The second filling device 110B is disposed such that it is associated specifically with the third lane 104C. FIG. 1A illustrates a single filling device 110B disposed such that the filling device 110B straddles and/or otherwise is substantially associated with the third lanes 104C on each side of the axis of symmetry B. Alternatively, two, second filling devices disposed one on either side of the axis of symmetry B are individually associated with the third lane 104C on each respective side. In another example, there is only a single filling device that is associated with each respective lane 104B-C.

FIG. 1B illustrates that the filling devices 110A-B are disposed above the web of film material 102 so that the filling devices 110A-B deposit a substance 112A-B in each of the chambers 106A-B. However, in some aspects, the filling devices 110A-B are, alternatively, disposed towards a side of the web of film material 102. Each of the filling devices 110A-B comprises a nozzle or other injection/deposition mechanism configured to deposit a defined quantity of the substance 112A-B within the chambers 106A-B. The quantity of the substance 112A-B is defined or otherwise determined based on a volume of the chambers 106A-B. Differently sized chambers may require more or less substance to be deposited. Accordingly, in some aspects, the filling devices 110A-B are controlled by a control device (e.g., a computer) to deposit the substance 112A-B based on the size of the chambers 106A-B formed.

In some non-limiting examples, the substance deposited into the chambers 106A-B is in the form of a powder, a liquid, a gel, a plurality of microbeads, or a combination thereof. In turn, the substance further comprises surfactants, bleaching agents, enzymes, bleach activators, corrosion inhibitors, scale inhibitors, cobuilders, dyes and/or perfumes, bicarbonates, soil release polymers, optical brighteners, dye transfer or redeposition inhibitors, defoamers, and/or mixtures thereof. In some aspects, the first filling device 110A deposits a first substance 112A into one or more of the formed chambers 106A of the second lane 104B. For example, the first filling device 110A is controlled such that the first substance 112A is only deposited into chambers 106A in every other column relative to the cross-machine direction where a side-by-side multi-chamber package is being formed. In another example, the first filling device 110A is controlled such that the first substance 112A is deposited into every chamber 106A where a superposed multi-chamber package is being formed. In some aspects, the second filling device 110B deposits a second substance 112B into one or more of the formed chambers 106B of the third lane 104C. For example, the second filling device 110B is controlled such that the second substance 112B is deposited into every chamber 106B or into chambers 106B in every other column relative to the cross-machine direction, where either a superposed or a side-by-side multi-chamber package is being formed. Notably, in some aspects, the first substance 112A is different from the second substance 112B, or the first and second substances 112A-B are the same.

In some aspects, the system 100 comprises folding mechanisms 114A-B configured to form a fold between the lateral lanes 104A-C in the machine direction A. In some aspects, the web of film material 102 is perforated in the machine direction A so as to define each of the lateral lanes 104A-C therebetween and, thus, facilitate or increase the ease at which the folding is accomplished. In various aspects, the folding mechanisms 114A-B comprise one or more rollers, rods, folding blocks, or any other suitable mechanism, configured to form a fold between lateral lanes. In other aspects, other types of folding mechanisms such as, for example, robotic arms are utilized. Otherwise, in particular aspects, the folds are formed manually by a system operator. In some aspects, a first folding mechanism 114A is disposed adjacent to the first lane 104A and the second lane 104B. The first folding mechanism 114A is configured to fold the web of film material 102 so that the first lane 104A is directed to overlie the one or more formed chambers 106A of the second lane 104B. In various aspects, such folding is simultaneously or substantially simultaneously mirrored across the axis of symmetry B. In other aspects, the second folding mechanism 114B is configured to fold the web of film material 102 so that the second lane 104B having the first lane 104A already folded thereon is directed to overlie the one or more formed chambers 106B of the third lane 104C.

Figure 2A:
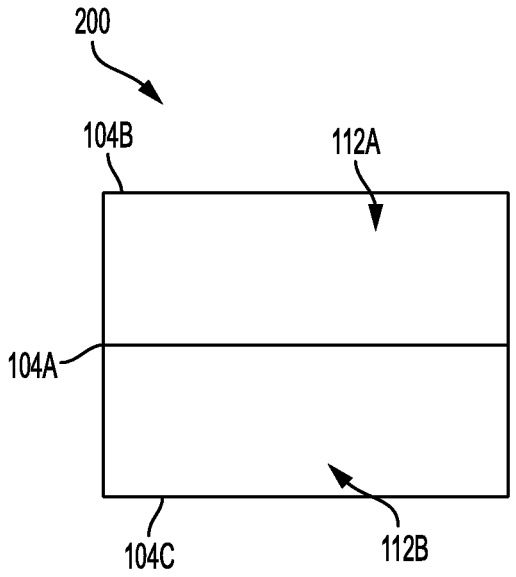
FIGS. 2A-2B illustrate a side view and a top view of a first exemplary multi-chamber package having superposed chambers, according to various aspects of the present disclosure.
Figure 2B:
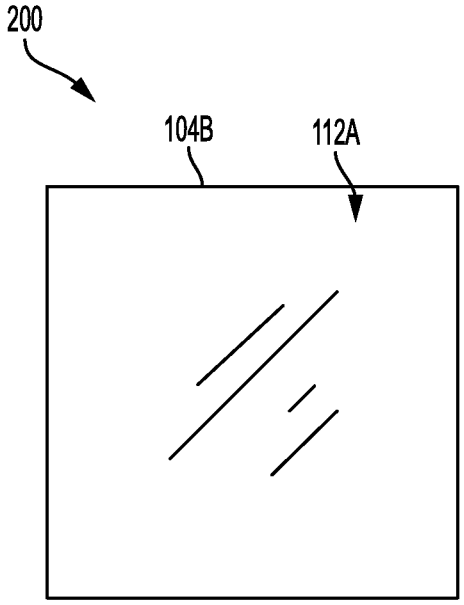

In some aspects, depending on the disposition of the chambers 106A-B, the result of the two-step folding process is a multi-chamber package having chambers superposed to one another or side-by-side to one another. FIGS. 2A-3B illustrate two exemplary arrangements of chambers of a multi-chamber package formed by the system 100. With regard to the aspects shown in FIGS. 2A-B, a multi-chamber package, generally designated 200, comprises two chambers superposed or one on top of the other. A side view of the multi-chamber package 200, illustrated in FIG. 2A, illustrates how, with the chambers superposed, the first substance 112A is enclosed in a chamber formed by the first lane 104A and the second lane 104B and is disposed on top of the second substance 112B, which is enclosed in a chamber formed by the first lane 104A and the third lane 104C. FIG. 2B illustrates the superposed multi-chamber package 200, where only the second lane 104B is substantially seen when viewed in a top view. The multi-chamber package 200 having superposed chambers is formed as described hereinabove, where the second lane 104B includes discrete regions comprising the formed chambers 106A extending in the machine direction A and for an entirety of or a substantial entirety of the cross-machine direction of the second lane 104B. The discrete regions comprising the formed chambers 106A are formed relative to cavities or depressions in a forming arrangement (e.g., platen 108, FIG. 1B). These formed chambers 106A correspond to formed chambers 106B in the third lane 104C, where the formed chambers 106B extend in the machine direction A and for an entirety of or a substantial entirety of the cross-machine direction of the third lane 104C in corresponding rows and/or columns. In particular aspects, the first substance 112A is deposited in each chamber 106A formed in the second lane 104B, while the second substance 112B is deposited in each chamber 106B formed in the third lane 104C. Accordingly, upon the first lane 104A being folded with respect to the second lane 104B, and the overlying combination of the first lane 104A and the second lane 104B being folded with respect to the third lane 104C, the first lane 104A will be disposed therebetween to thereby form a superposed multi-chamber package, like the package illustrated in FIGS. 2A-B.

Figure 3B:
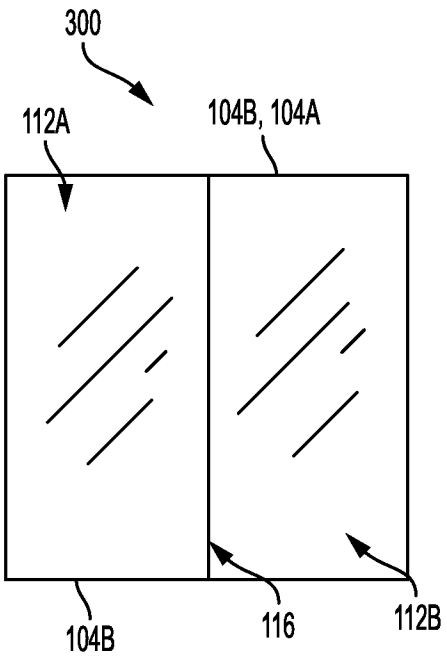
FIGS. 3A-3B illustrate a side view and a top view of a second exemplary multi-chamber package having side-by-side chambers, according to various aspects of the present disclosure.
Figure 3A:
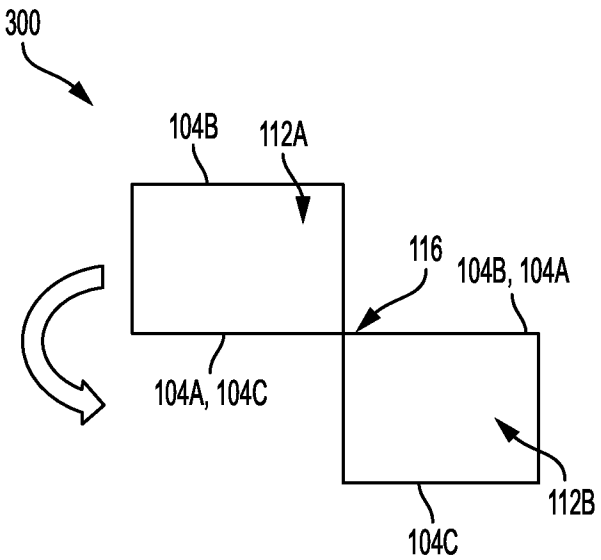

With regard to the aspects shown in FIGS. 3A-B, a multi-chamber package, generally designated 300, comprises two chambers disposed adjacent or side-by-side to the other. A side view of the multi-chamber package 300, illustrated in FIG. 3A, illustrates how, with the chambers adjacently disposed, the first substance 112A is enclosed in a chamber formed by the second lane 104B on top and the first lane 104A and the third lane 104C underneath. The chamber enclosing the first substance 112A is disposed next or adjacent to the second substance 112B, which is enclosed in a chamber formed by the first lane 104A and the second lane 104B on top and the third lane 104C on the bottom.

As illustrated in FIG. 3A, for example, the two chambers are disposed in different planes relative one another. In some aspects, a web of film material between the first chamber (i.e., the chamber enclosing the first substance 112A) and the second chamber (i.e., the chamber enclosing the second substance 112B), generally referred to as reference numeral 116, is sufficiently flexible. As such, in this aspect, upon formation of each of the first chamber and the second chamber, the first chamber and/or the second chamber equalizes or settles, which results in the two chambers being substantially coplanar. In other aspects, however, the first chamber folds at the web of film material between the two chambers 116, such that the web of film material between the two chambers 116 acts as a hinge. Once folded, the two chambers are sealed or otherwise secured together via, for example, at least one sealing mechanism.

FIG. 3B illustrates the side-by-side multi-chamber package 300, where the second lane 104B enclosing the first substance 112A and the second lane 104B overlying the first lane 104A and enclosing the second substance 112B is substantially seen when viewed in a top view. The hinge of material 116 separating the two chambers is also seen. The multi-chamber package 300 having side-by-side chambers is formed as described hereinabove, where the second lane 104B includes discrete regions comprising the formed chambers 106A extending in the machine direction A and for an entirety of or a substantial entirety of the cross-machine direction of the second lane 104B. The discrete regions comprising the formed chambers 106A are formed relative to cavities or depressions in a forming arrangement (e.g., platen 108, FIG. 1B). These formed chambers 106A correspond to formed chambers 106B in the third lane 104C, where the formed chambers 106B extend in the machine direction A and in a discrete region, or for an entirety of or a substantial entirety of the cross-machine direction of the third lane 104C in corresponding rows and/or columns. However, unlike the exemplary superposed multi-chamber package 200 referenced with regard to FIGS. 2A-B, the side-by-side multi-chamber package 300 only has the first substance 112A deposited in chambers 106A formed in every other column relative to the cross-machine direction of the second lane 104B, and the second substance 112B deposited in chambers 106B formed in every other column relative to the cross-machine direction of the third lane 104C. The chambers 106A devoid of the first substance 112A or a discrete region of the second lane 104B not having chambers formed therein correspond to the chambers 106B filled with the second substance 112B. Likewise, the chambers 106A filled with the first substance 112A correspond to the chambers 106B devoid of the second substance or a discrete region of the third lane 104C not having chambers formed therein. Accordingly, upon the first lane 104A being folded with respect to the second lane 104B, and the overlying combination of the first lane 104A and the second lane 104B being folded with respect to the third lane 104C, the first lane 104A will be disposed therebetween and thereby form a side-by-side multi-chamber package, like the package 300 illustrated in FIGS. 3A-B.

In various aspects, the system 100 also comprises additional elements, such as at least one sealing mechanism. The at least one sealing mechanism is integrated with or otherwise disposed separately from the folding mechanisms 114A-B. Prior to folding or during folding, once the substances 112A-B have been deposited in respective chambers 106A-B, in various aspects, the sealing mechanism is configured to apply an aqueous fluid to a substantial entirety of a surface of one or more of the lanes 104A-C such that, once the lateral lanes overlie one another, a seal is formed therebetween. In some aspects, there are one or more sealing mechanisms. For example, a first sealing mechanism is disposed relative to the first lane 104A and is configured to apply an aqueous fluid to the first lane 104A or about the formed chambers 106A of the second lane 104B in order to seal the formed chambers 106A, once the first substance 112A is deposited therein. In another example, a second sealing mechanism is disposed relative to the second lane 104B, and is configured to apply an aqueous fluid to the first lane 104A that overlies the second lane 104B or about the formed chambers 106B of the third lane 104C in order to seal the formed chambers 106B once the second substance 112B is deposited therein. In other examples, a single sealing mechanism that is configured to deposit an aqueous fluid in select locations in each of the lateral lanes 104A-C is utilized in the system 100. The at least one sealing mechanism alternatively comprises a heat sealing mechanism that is otherwise able to heatedly seal the lateral lanes to one another after the fold has been completed. Otherwise, in other aspects, the web of film material 102 is self-adhering and the system 100 does not require a sealing mechanism.

In other aspects, the system 100 further comprises at least one cleaning device. The cleaning device is integrated with or otherwise disposed separately from the folding mechanisms 114A-B and is configured to remove unwanted material from the formed chambers 106A-B. For example, any debris, extraneous aqueous fluid, scrap film material 102, etc., which may impede a successful fold and/or seal is removed by the at least one cleaning device. In some non-limiting examples, the at least one cleaning device includes a blower, a brush, a wipe, a sponge, a vacuum, etc. The at least one cleaning device is disposed, relative to the machine direction A, prior to the folding mechanisms 114A-B. For example, in some aspects, a first cleaning device is disposed prior to the first folding mechanism 114A and a second cleaning device is disposed after the first folding mechanism 114A, but before the second folding mechanism 114B. In some aspects, there is at least one cleaning mechanism on each side of the axis of symmetry B.

In still other aspects, the system 100 further comprises a cutting mechanism 118. FIG. 1A illustrates the cutting mechanism 118 disposed relative to the web of film material 102 in the machine direction A after the multi-chamber packages have been formed, yet are still attached to one another in the web of film material 102. The cutting mechanism 118 is configured to divide the web of film material 102 between adjacent multi-chamber packages, such that each resulting individual multi-chamber package includes at least a formed chamber 106A of the second lane 104B having the first substance 112A therein and a formed chamber 106B of the third lane 104C having the second substance 112B therein. Depending on the forming arrangement used, the multi-chamber package comprises superposed chambers or side-by-side chambers. Other chamber arrangements are also contemplated based on the forming arrangement (e.g., platen 108) used. Non-limiting examples of the cutting mechanism 118 include at least one of a scissor, at least one knife, etc., movable in the machine direction A and/or the cross-machine direction. Consequently, the divided multi-chamber packages provide a single dose of the substance(s) therein for cleaning applications.

Figure 4:
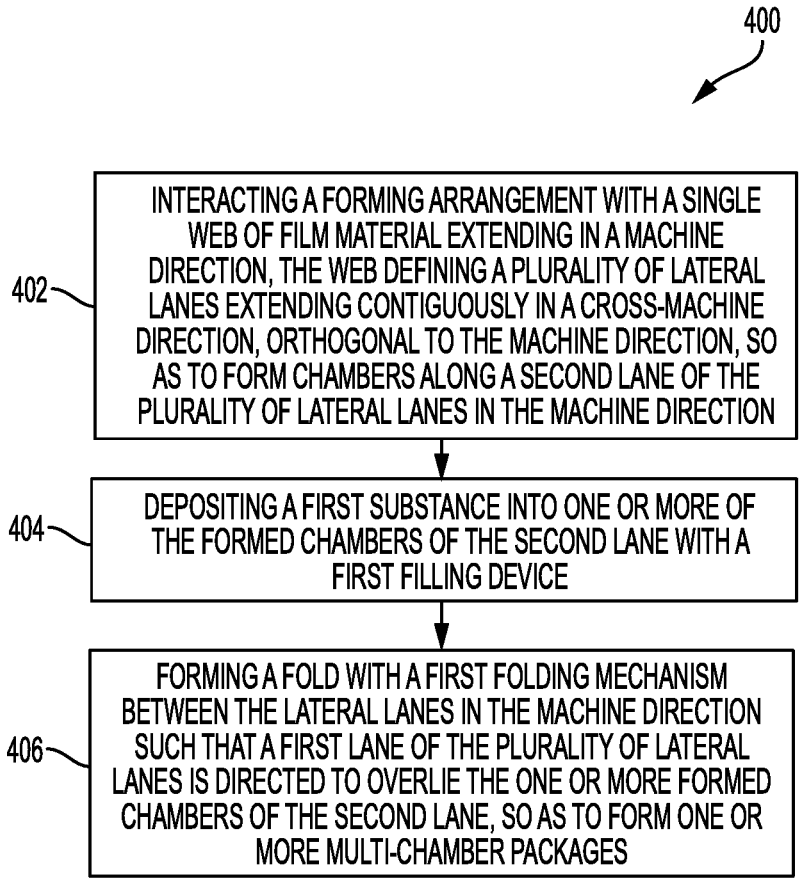
FIG. 4 illustrates a method for forming a multi-chamber package, according to various aspects of the present disclosure.

With regard to FIG. 4, a method for forming a multi-chamber package, generally designated 400, is provided. Aspects of the method 400 utilize a system, such as the system 100 described in reference to FIGS. 1A-B. In a first step, 402, the method comprises interacting a forming arrangement with a single web of film material 102 extending in a machine direction A, the web 102 defining a plurality of lateral lanes 104A-C extending contiguously in a cross-machine direction, orthogonal to the machine direction A, so as to form chambers 106A along a second lane 104B of the plurality of lateral lanes in the machine direction A. In a second step, 404, the method comprises depositing a first substance 112A into one or more of the formed chambers 106A of the second lane 104B with a first filling device 110A.

In a third step, 406, the method comprises forming a fold between the lateral lanes 104A-C in the machine direction A with a first folding mechanism 114A such that a first lane 104A of the plurality of lateral lanes is directed to overlie the one or more formed chambers 106A of the second lane 104B, and so as to form one or more multi-chamber packages.

In some aspects, the method 400 further comprises forming chambers 106B along the third lane 104C in the machine direction A, depositing a second substance 112B into the one or more formed chambers 106B of the third lane 104C, and subsequently forming a second fold in the machine direction A such that the second lane 104B is directed to overlie the one or more formed chambers 106B of the third lane 104C, with the first lane 104A being disposed therebetween, so as to form one or more multi-chamber packages. Many different types or styles of multi-chamber packages are formed using such methodology, including, for example, superposed multi-chamber packages and side-by-side multi-chamber packages.

Many modifications and other embodiments of the disclosure set forth herein will come to mind to one skilled in the art to which these disclosure pertain having the benefit of the teachings presented in the foregoing descriptions. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A system for forming a multi-chamber package, the system comprising:

a single web of a film material extending in a machine direction and defining a plurality of lateral lanes extending contiguously in a cross-machine direction, orthogonal to the machine direction;

a forming arrangement configured to interact with the web to form chambers along a second lane and along a third lane of the plurality of lateral lanes in the machine direction, the third lane extending contiguously from the second lane in a cross-machine direction, orthogonal to the machine direction;

a first filling device configured to deposit a first substance into one or more of the formed chambers of the second lane; and a first folding mechanism configured to form a fold between the lateral lanes in the machine direction such that an first lane of the plurality of lateral lanes is directed to overlie the one or more formed chambers of the second lane, so as to form one or more multi-chamber packages.

2. The system according to claim 1, wherein the film material comprises a water soluble film material.

3. The system according to claim 1, wherein the web has a lateral width of about 54 inches orthogonally to the machine direction.

4. The system according to claim 1, wherein the forming arrangement is configured to exert a negative pressure through a platen having the web engaged therewith so as to form the chambers in the second lane or the third lane.

5. The system according to claim 1, comprising a second filling device configured to deposit a second substance into one or more of the formed chambers of the third lane.

6. The system according to claim 5, wherein each of the first and second substances comprises a powder, a liquid, a gel, a plurality of microbeads, or a combination thereof.

7. The system according to claim 5, wherein the first substance is different from the second substance.

8. The system according to claim 5, comprising a second folding mechanism configured to form a fold between the lateral lanes in the machine direction such that a second lane is directed to overlie the one or more formed chambers of the third lane, with the first lane being disposed therebetween, so as to form one or more multi-chamber packages.

9. The system according to claim 8, wherein the web includes an axis of symmetry extending in the machine direction, such that the first through third lanes are mirrored on each side of the axis of symmetry, and wherein the forming arrangement, the first and second filling devices, and the first and second folding mechanisms are mirrored on each side of the axis of symmetry.

10. The system according to claim 8, further comprising a cutting mechanism configured to divide the web between adjacent multi-chamber packages, such that each resulting individual multi-chamber package includes a formed chamber of the second lane having the first substance therein and a chamber of the third lane having the second substance therein.

11. The system according to claim 8, wherein the second lane includes discrete regions devoid of the formed chambers, the discrete regions corresponding to the formed chambers in the third lane such that, upon the second lane being folded with respect to the third lane, with the first lane therebetween, a multi-chamber package is formed comprising two chambers disposed laterally adjacent to one another.

12. The system according to claim 8, wherein the second lane includes discrete regions comprising the formed chambers, the discrete regions corresponding to the formed chambers in the third lane such that, upon the second lane being folded with respect to the third lane, with the first lane therebetween, a multi-chamber package is formed comprising two superposed chambers.

13. The system according to claim 1, further comprising at least one cleaning device configured to remove unwanted material from the formed chambers.

14. The system according to claim 1, further comprising at least one sealing device configured to apply an aqueous fluid to the first lane or about the formed chambers of the second lane in order to seal the formed chambers upon the first lane being folded to overlie the one or more formed chambers of the second lane.

15. A method for forming a multi-chamber package, the method comprising:

(a) interacting a forming arrangement with a single, web of film material extending in a machine direction, the web defining a plurality of lateral lanes extending contiguously in a cross-machine direction, orthogonal to the machine direction, so as to form chambers along a second lane and along a third lane of the plurality of lateral lanes in the machine direction, the third lane extending contiguously from the second lane in a cross-machine direction, orthogonal to the machine direction;

(b) depositing a first substance into one or more of the formed chambers of the second lane with a first filling device; and (c) forming a fold between the lateral lanes in the machine direction with a first folding mechanism such that a first lane of the plurality of lateral lanes is directed to overlie the one or more formed chambers of the second lane, so as to form one or more multi-chamber packages.

16. The method according to claim 15, wherein step (a) further comprises exerting negative pressure through a platen having the web engaged therewith so as to form the chambers in the second lane or the third lane.

17. The method according to claim 15, wherein step (b) further comprises depositing a second substance into one or more of the formed chambers of the third lane with a second filling device.

18. The method according to claim 17, wherein the web includes an axis of symmetry extending in the machine direction, such that the method comprises mirroring steps (a)-(c) on each side of the axis of symmetry.

19. The method according to claim 17, further comprising dividing the web between adjacent multi-chamber packages with a cutting mechanism, such that each resulting individual multi-chamber package includes a formed chamber of the second lane having the first substance therein and a chamber of the third lane having the second substance therein.

20. The method according to claim 17, wherein step (c) further comprises forming a fold between the lateral lanes in the machine direction with a second folding mechanism such that a second lane is directed to overlie the one or more formed chambers of the third lane, with the first lane being disposed therebetween, so as to form one or more multi-chamber packages.

21. The method according to claim 20, wherein the second lane includes discrete regions devoid of the formed chambers, the discrete regions corresponding to the formed chambers in the third lane such that step (c) comprises forming a multi-chamber package comprising two chambers disposed laterally adjacent to one another upon the second lane being folded with respect to the third lane, with the first lane therebetween.

22. The method according to claim 20, wherein the second lane includes discrete regions comprising the formed chambers, the discrete regions corresponding to the formed chambers in the third lane such that step (c) comprises forming a multi-chamber package comprising two superposed chambers upon the second lane being folded with respect to the third lane, with the first lane therebetween.

23. The method according to claim 15, further comprising removing unwanted material from the formed chambers using at least one cleaning device.

24. The method according to claim 15, further comprising applying an aqueous fluid to the first lane or about the formed chambers of the second lane using at least one sealing device in order to seal the formed chambers upon the first lane being folded to overlie the one or more formed chambers of the second lane.

* * * * *